United States Patent [19]

Rommel et al.

[11] Patent Number: 4,711,292

[45] Date of Patent: Dec. 8, 1987

[54] CORE AND SHELL SHOOTER

[75] Inventors: Reiner Rommel; Werner Landaua, both of Mannheim, Fed. Rep. of Germany

[73] Assignee: Adolf Hottinger Giesserei und Maschinenbau GmbH

[21] Appl. No.: 37,613

[22] Filed: Apr. 13, 1987

Related U.S. Application Data

[63] Continuation of Ser. No. 745,915, Jun. 18, 1985, abandoned.

[30] Foreign Application Priority Data

Jun. 19, 1984 [DE] Fed. Rep. of Germany ..... 3422687

[51] Int. Cl.[4] ..... B22C 13/08; B22C 13/12; B22C 15/26

[52] U.S. Cl. ..... 164/200; 164/201; 164/228

[58] Field of Search ..... 164/200, 201, 202, 165, 164/228, 21, 20, 22

[56] References Cited

U.S. PATENT DOCUMENTS 1,533,220 4/1925 Campbell ..... 164/200 X

FOREIGN PATENT DOCUMENTS 225639 11/1958 Australia ..... 164/201
1145750 3/1963 Fed. Rep. of Germany ..... 164/201
1155883 10/1963 Fed. Rep. of Germany ..... 164/165
778973 7/1957 United Kingdom ..... 164/201

OTHER PUBLICATIONS

Informational brochure of the Hottinger Company, 1979, pp. 9 to 13.

Advertisement from Foundry Journal, May 1978, p. 51.

*Primary Examiner*—M. Jordan
*Assistant Examiner*—J. Reed Batten, Jr.
*Attorney, Agent, or Firm*—Toren, McGeady & Associates

[57] ABSTRACT

A core or shell blow (shoot) machine, equipped with a quick core-box change device, makes it possible to carry out a quick core-box change in just a few minutes, thereby reducing down time. For this purpose, the core-box change device consists of a twin carrier which is swung hydraulically in a horizontal plane about a vertical axis. The care-box in the machine, after picking up the cope and the cope ejector plate, is lowered by the lift table into the carrier, after hydraulic clamps between the table and the core-box bolster have been released. The core-box change device is then rotated 180°, which swings the old core-box out of the machine and, simultaneously, swings the new core-box stack-up into the machine over the lift table. In the meantime, the old blow-plate is removed from the sand magazine, outside of the machine, using the blow-plate removal device. This layout also allows collection of the remaining sand from the sand magazine in a collecting pan, which is part of the blow-plate removal device, insuring a clean, trouble-free core-box change.

1 Claim, 2 Drawing Figures

1
4
3
8e
8c
2
5
8d
II
II
9e
9d
9c
8b
7'
7
1
9b
10
6
9a
8a
6
1
1
1
11

CORE AND SHELL SHOOTER

This is a continuation application of Ser. No. 745,915, filed June 18, 1985 and now abandoned.

BACKGROUND OF THE INVENTION

1. Field of the Invention

The invention relates to a core and shell blow (shoot) machine.

2. Description of Related Art

In the case of known machines of the above-mentioned type, which have applications as single-station or multi-station systems in foundry and plastics technology and are used for the production of cores, core-sand molds and shells, when it is desired to change the core-box (including a change of the blow-plate and the cope ejector device), it is necessary to shut down the machine or the system for a prolonged period of time. The core-box must then be laboriously removed from the core-box carrier by means of an overhead hoist before a new core-box can be loaded into the core-box carrier in the same way. Changing the blow-plate and the cope ejector device within the machine is also very time consuming and complex. Hence, it is not possible, in this way, to perform a fast and cost effective core-box change, including the blow-plate and the cope ejector device.

German Patent Specification No. 3,148,461 discloses a vertically separated core and shell blowing (shooting) machine consisting of a machine stand, a blow (shooting) device connected with a core device which both rotate, in position, about a vertical axis, a blow-plate changing device, and a core-box changing device featuring a double-sided core-box carrier which allows the new core-box to rotate, about a horizontal axis, into, while simultaneously, the old core-box rotates out of the machine.

SUMMARY OF THE INVENTION

The object of the present invention is to use a device similar to the above-mentioned type to perform an automatic change of horizontally separated core-boxes, including the matching blow-plates and the cope ejector devices, without having to shut down the machine for this purpose.

According to the invention, the core-box change can be carried out in just a few minutes. For this purpose, the core-box change device consists of a twin-carrier which is swung hydraulically in a horizontal plane about a vertical axis. The core-box in the machine, after picking up the cope and the cope ejector plate, is lowered by the lift table into the carrier, after the hydraulic clamps between the table and the core-box bolster have been released. The core-box change device is then rotated 180°, which swings the old core-box out of the machine and simultaneously swings the new core-box stack-up into the machine over the lift table. In the meantime, the old blow-plate is removed from the sand magazine, outside of the machine, using the blow-plate removal device. This arrangement also allows collection of the remaining sand from the sand magazine in a collecting pan, which is part of the blow-plate removal device, which insures a clean, trouble-free core-box change.

The new core-box stack-up, consisting of a bolster, drag, cope, cope ejector plate and blow-plate stacked one on top of the other, is now sitting, supported by the core-box change device, above the lift table. When the hydraulic lift table is moved up, the stack-up is raised until the cope is pressed against the cope arrestor, which is rigidly connected to the machine frame. The cope is then connected to the cope arrestor by a pneumatic/mechanical interlock.

The sand magazine, in the meantime, has been shuttled from the sand fill station into the blow station. The sand magazine is lowered, by a hydraulic cylinder mounted to the machine frame, until it contacts the new blow-plate which is resting on top of the core-box stack-up. The blow-plate is then automatically fastened to the sand magazine. The sand magazine with the new blow-plate attached thereto is then retracted and transferred over to the sand fill station. The cope ejector device, in hot box machines combined with the upper burner manifold, and in cold box machines combined with the gassing manifold, is then transferred into the machine and lowered, by the above hydraulic cylinder, until it contacts the cope and thereby encompasses the cope ejector plate, which is resting on top of the cope. The cope ejector plate is then mechanically clamped to the cope ejector device.

The cope ejector plate is used during the core-box opening cycle to insure that the core or the shell stays with the drag. The cope ejector plate holds ejector pins which are aligned with blow-holes in the cope. The ejector pins are of such a length that, when the ejector plate is in the retracted position, the ejector pins penetrate through the blow-holes and terminate at the cope surface. As the drag, pulled by the lift table, starts to move away from the stationary cope, the eject cylinder moves the ejector plate with the ejector pins. This can be done in two different ways, i.e., either delayed to eject the core from the cope, or synchronously to insure that the core stays with the drag. The control sequence for the quick core-box change can be provided either in a manual or fully automatic mode.

BRIEF DESCRIPTION OF THE DRAWINGS

With the above and additional objects and advantages in mind as will hereinafter appear, the invention will be described with reference to the accompanying drawings, in which.

DESCRIPTION OF THE PREFERRED EMBODIMENT

Figure 1:
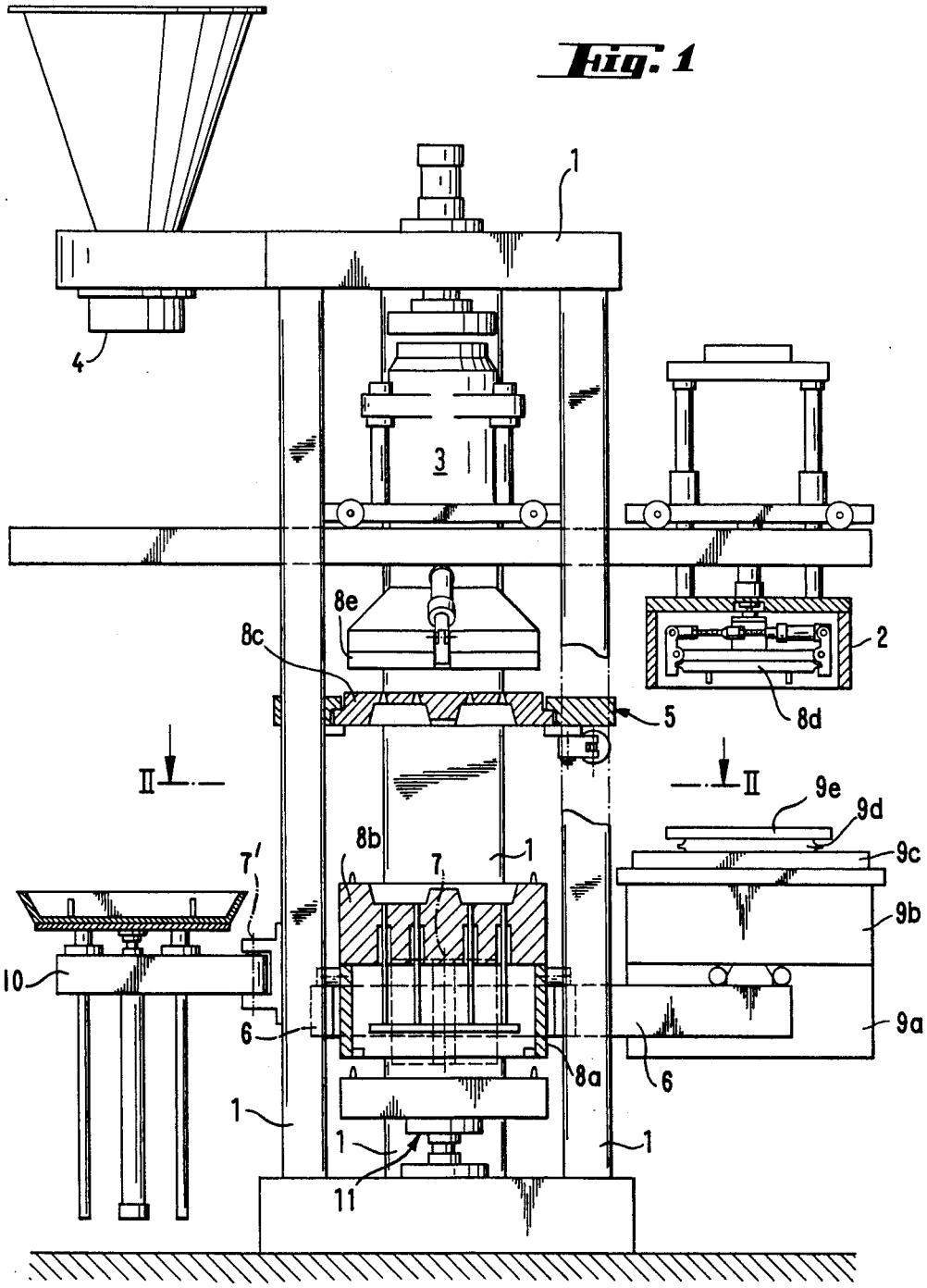
FIG. 1 shows, diagrammatically, a section through a machine according to the invention as seen from the front.

The machine frame 1 contains a cope ejector device 2, a blow device 3, a sand fill assembly 4, a cope arrestor 5, a core-box change device 6, consisting of twin core-box supports which can be swung horizontally about a vertical axis 7. Using the core-box change device, the old core-box assembly 8, consisting of a bolster 8*a*, a drag 8*b*, a cope 8*c* and a cope ejector plate 8*d*, can be swung out of the machine and, simultaneously, a new core-box stack-up 9, consisting of a bolster 9*a*, a drag 9*b*, a cope 9*c*, a core ejector plate 9*d*, and a blow-plate 9*e*, is swung into the machine over the lift table 11.

Figure 2:
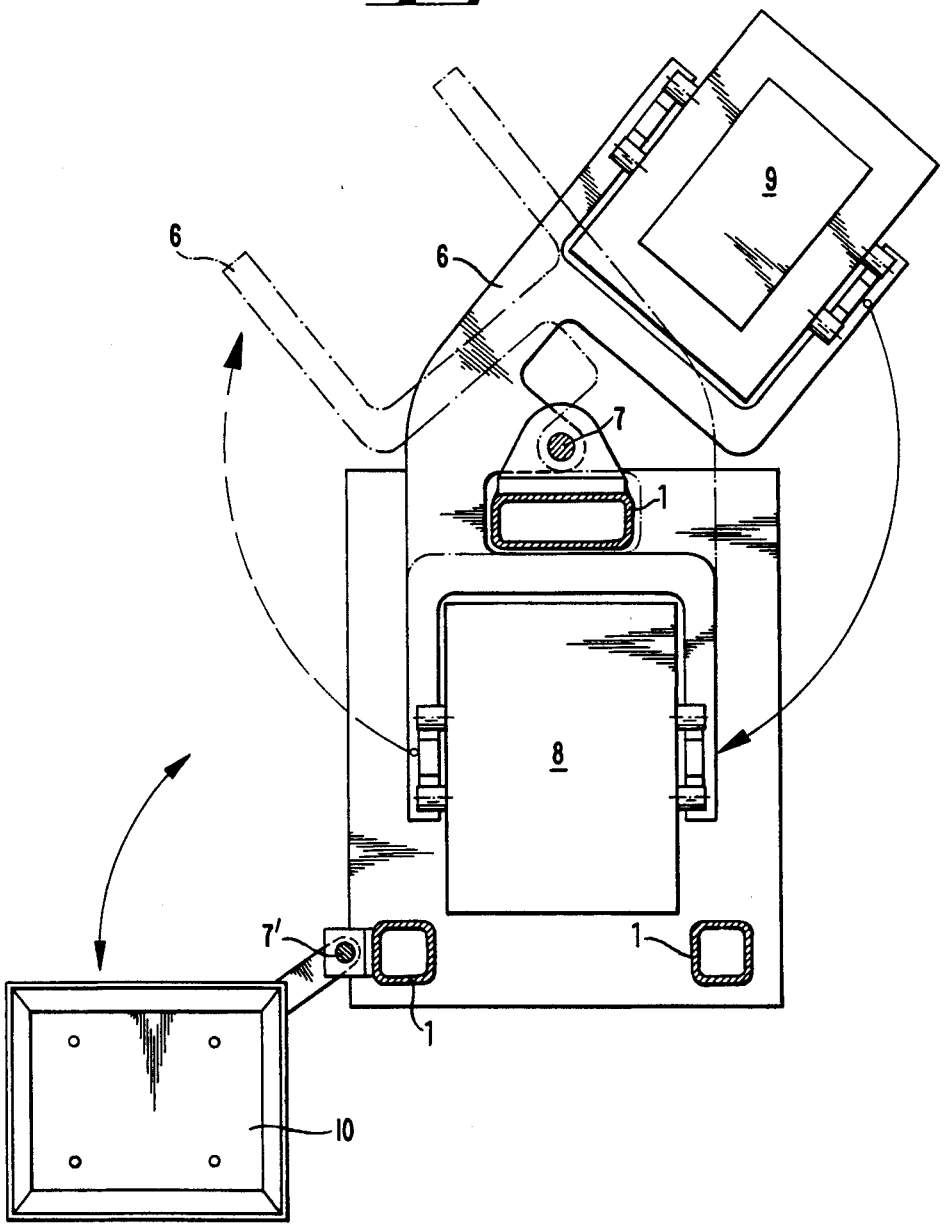
FIG. 2 shows, diagrammatically, the core-box change device and the blow-plate change device.

In the meantime, the blow device 3 has been shuttled over to the sand fill station 4, where the old blow-plate 8*e* is removed using the blow-plate removing device 10. To achieve this, the blow-plate changing device 10 is swung horizontally about a vertical axis 7′ as shown in FIG. 2.

We claim:

1. A core and shell blowing machine comprising a machine frame, a cope eject device, a blow device, and a related blow-plate removal device, a sand fill assembly, a cope arrestor, a lift device, and a core-box change device consisting of twin core-box supports, characterized in that the core-box change device is arranged to be swung horizontally about a vertical axis, bringing the core-box out of the machine and, simultaneously, a new core-box into the machine above the lift device.

* * * * *

UNITED STATES PATENT AND TRADEMARK OFFICE

CERTIFICATE OF CORRECTION

PATENT NO. : 4,711,292

DATED : December 8, 1987

INVENTOR(S) : Reiner Rommel et al

It is certified that error appears in the above-identified patent and that said Letters Patent is hereby corrected as shown below:

In the heading of the Patent, it should read:

[75] Inventors: Reiner Rommel; Werner Landua

Signed and Sealed this

Twelfth Day of April, 1988

*Attest:*

DONALD J. QUIGG

*Attesting Officer*

*Commissioner of Patents and Trademarks*